United States Patent [19]

Ozaki

[11] 4,250,832

[45] Feb. 17, 1981

[54] APPARATUS FOR STORING RADIOACTIVE MATERIALS

[75] Inventor: Satoru Ozaki, Ichikawa, Japan

[73] Assignee: Tokyo Shibaura Denki Kabushiki Kaisha, Kawasaki, Japan

[21] Appl. No.: 964,147

[22] Filed: Nov. 28, 1978

[30] Foreign Application Priority Data

Dec. 16, 1977 [JP] Japan ..... 52-150618

[51] Int. Cl.[2] ..... C23C 13/08

[52] U.S. Cl. ..... 118/724; 427/38; 427/5; 250/492; 252/301.1 W

[58] Field of Search ..... 118/49.1, 724; 427/38, 427/5; 252/301.1 W; 250/492

[56] References Cited

U.S. PATENT DOCUMENTS

| | | | |
|---|---|---|---|
| 2,820,722 | 1/1958 | Fletcher | 427/38 |
| 3,326,178 | 6/1967 | Angelis | 427/5 |
| 3,380,853 | 4/1968 | Angelis | 427/5 |
| 3,704,216 | 11/1972 | Kinstley | 118/49.1 |
| 3,908,183 | 9/1975 | Ennis | 427/38 |
| 4,051,063 | 9/1977 | Nelson | 252/301.1 W |

*Primary Examiner*—Sam Silverberg

*Attorney, Agent, or Firm*—Oblon, Fisher, Spivak, McClelland & Maier

[57] ABSTRACT

A method and apparatus for storing radioactive materials, in which a metal halide or a metal carbonyl compound is introduced from a cylinder to the vicinity of a solid material while a gaseous radioactive material provided from a reservoir, ionized and accelerated is being implanted into the solid material, so as to allow the elemental metal to be deposited on the surface of the solid material, thereby detaining the radioactive material in the solid material and newly providing the surface of the solid material with a metal layer for multilayer implantation.

8 Claims, 1 Drawing Figure

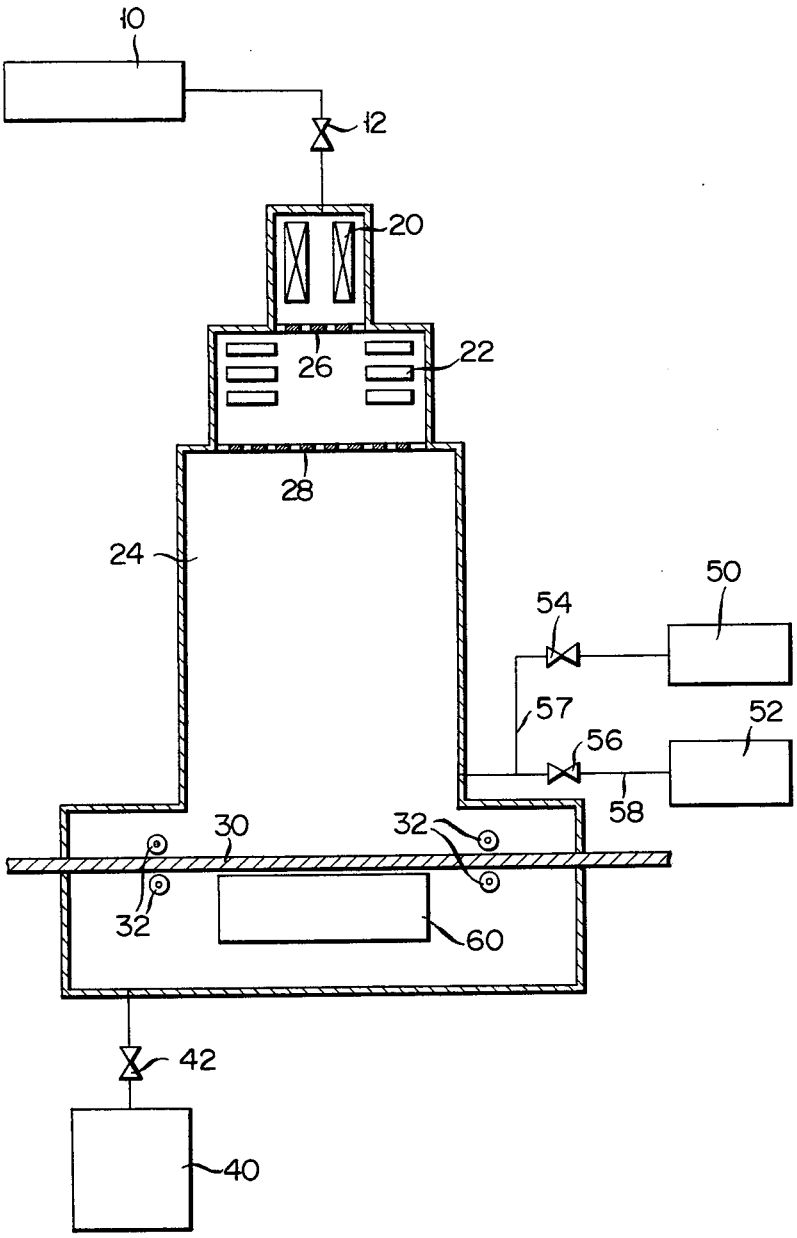
10
12
20
26
22
28
24
50
54
57
52
56
58
30
32
32
60
42
40

APPARATUS FOR STORING RADIOACTIVE MATERIALS

BACKGROUND OF THE INVENTION

1. Field of the Invention

This invention relates to a method and apparatus for storing radioactive materials or harmful substances by detaining them in a solid material.

2. Description of the Prior Art

It is strongly required nowadays to develop a technique for disposal or storing of the radioactive wastes coming from re-processing steps of nuclear fuels. Among such radioactive wastes, a typical example of gaseous material is Kr-85. Since Kr-85 has a half-life period of 10.7 years, it is necessary to store Kr-85 safely for at least 100 years. But, a gas cylinder which is widely used nowadays fails to meet the requirement of such a long period of safe storage.

Japanese Patent Disclosure No. 89799/75 proposes a method of storing radioactive materials or harmful materials into a solid material, which comprises bombarding the solid material with ionized radioactive materials such as Kr-85. This publication also teaches the idea of forming a metal layer by sputtering or vapor deposition on the surface of the solid material having the radioactive material implanted thereinto so as to prevent the implanted material from being released from the solid material. For example, implantation of ionized Kr-85 is stopped and, then, a metal layer is newly formed by sputtering on the surface of the solid material into which the ionized Kr-85 has been implanted. The newly formed metal layer serves to ensure detaining the implanted material in the solid material and, at the same time, provides a new solid material for multilayer implantation. Then, a cycle of ion implantation into the new metal layer and formation of an additional metal layer by sputtering is repeated several times.

Certainly, the method disclosed in the prior publication mentioned above permits storing radioactive wastes safely and advantageously over a long period of time, but leaves room for further improvements. Namely, the ion implantation and the metal layer formation are carried out independently, leading to troublesome operations and low processing efficiency. Particularly, the sputtering process employed for forming a metal layer on the surface of a solid material necessitates electrode replacement etc., resulting in an inefficient storing operation.

SUMMARY OF THE INVENTION

An object of this invention is to provide a method and apparatus for storing radioactive materials or harmful materials, in which said materials are implanted into a solid material and a new metal layer is formed on the surface of the solid material. The implantation and the metal layer formation are performed continuously and simultaneously, permitting the radioactive materials or the harmful materials to be stored very easily with high efficiency.

According to this invention, there is provided a method of storing radioactive materials, comprising introducing a metal halide compound or a metal carbonyl compound to the vicinity of a solid material into which the radioactive material is implanted while a gaseous radioactive material, ionized and accelerated, is being implanted into said solid material so as to allow the elemental metal liberated from the metal compound to be deposited on the surface of the solid material, thereby detaining the radioactive material in the solid material and, at the same time, providing a new metal layer for multi-layer implantation on the surface of the solid material.

The metal halide compound or the metal carbonyl compound may be introduced singly or together with a carrier gas such as nitrogen gas. Also, the metal halide may be introduced together with hydrogen gas. In this case, the metal halide is reduced by the hydrogen so as to deposit the elemental metal.

According to this invention, there is also provided an apparatus for storing radioactive materials, comprising means for introducing a metal halide compound or a metal carbonyl compound to the vicinity of a solid material into which the radioactive material is implanted, means for controlling the temperature of said solid material, and means for introducing a carrier gas or hydrogen gas, as required.

BRIEF DESCRIPTION OF THE DRAWING

This invention can be more fully understood from the following detailed description when taken in conjunction with the accompanying drawing, in which:

The sole FIGURE is a schematic partially diagrammatic sectional view of an apparatus for storing radioactive materials, according to one embodiment of this invention.

DETAILED DESCRIPTION OF THE PREFERRED EMBODIMENTS

The metal carbonyl compounds used in this invention include, for example, nickel carbonyl, iron carbonyl and chromium carbonyl. These metal carbonyl compounds are decomposed at temperatures lower than 200° to 300° C. For example, nickel carbonyl is decomposed at 140° to 240° C. to deposite nickel metal as shown below:

$$Ni(CO)_4 \rightarrow Ni + 4CO$$

This metal deposition method, which is called the carbonyl method, is employed for the production of high purity metal. Since the surface of the solid material is heated to a considerably high temperature in general by the bombardment of accelerated ions, it is unnecessary to supply from outside the heat required for the thermal decomposition of the metal carbonyl compound. On the contrary, it is preferred to employ cooling for protecting the solid material from thermal damage. In this invention, it is desirable to control the temperature of the solid material to fall within the range of from 300° C. to 800° C. Besides the thermal decomposition, irradiation of high speed particles and radiations such as X-rays, ultraviolet light, etc. may be used for decomposing the metal carbonyl compound to deposit the elemental metal. Where, for example, the metal carbonyl compound is introduced during the step of implating the accelerated ions of the radioactive material into the solid material, the accelerated ions are irradiated to the metal carbonyl compound, promoting the decomposition of the metal carbonyl compound.

The metal halide compounds used in this invention include, for example, chlorides, bromides and iodides of silicon, germanium, titanium, zirconium, hafnium, vanadium, chromium, tantalum, iron, cobalt, copper, beryllium, niobium, molybdenum and tungsten. The metal halide is thermally decomposed or reduced by hydrogen under temperatures lower than 1000° to 3000° C. so as to deposite the elemental metal. Also, irradiation of high speed particles and radiations may be employed for decomposing the metal halide as is the case with the metal carbonyl compound. In general, the temperature at which the metal halide is thermally decomposed or reduced by hydrogen is higher than the temperature at which the metal carbonyl is thermally decomposed. However, it is desirable to control the temperature of the solid material to fall within the range from 300° C. to 800° C. as mentioned previously even for the case of using the metal halide, because irradiation of the ionized krypton particles to the metal halide also contributes to the thermal decomposition or reduction by hydrogen of the metal halide. Needless to say, hydrogen gas should be supplied together with the metal halide where reduction by hydrogen is used for the metal deposition. It should be noted that metal halides such as chronium iodide, titanium iodide, iron chloride, cobalt chloride, zirconium chloride and titanium chloride tend to be readily decomposed by irradiation of high speed particles. Particularly, metal halides having a low melting point are readily decomposed to deposit the elemental metal by irradiation of the accelerated ions of the radioactive material regardless of the ambient temperature.

Where accelerated ions of a radioactive material are implanted into a solid material, the implantation chamber is kept in general at a vacuum of less than $10^{-3}$ torr. In order that the implantation of the accelerated ions may not be interrupted, it is preferred to introduce the metal halide or metal carbonyl at a partial pressure of $10^{-1}$ to $10^{-4}$ torr.

In this invention, at least one compound selected from metal halides and metal carbonyls is used as the metal source, and at least one of thermal decomposition, decomposition utilizing irradiation of high speed particles, radiolysis, and reduction by hydrogen is employed for liberating the elemental metal from said metal compound. It is important to note that this invention permits depositing the elemental metal without interrupting the implantation of the accelerated ions such as ionized Kr-85.

The sole FIGURE shows an apparatus for storing radioactive materials according to one embodiment of this invention. The apparatus comprises an ion implantation unit consisting essentially of an ionizer or ion source 20, an accelerator 22 and an implantation chamber 24. An evacuation means 40 is connected to the implantation chamber 24 in order to maintain the interior of the apparatus body at a vacuum condition. It is seen that a solid material 30 into which the ionized radioactive material is to be implanted, for example, a metal such as copper, nickel or aluminum or an alloy like stainless steel is housed in the implantation chamber 24. Incidentally, an ion implantation unit of this type is desclosed in, for example, U.S. Pat. application Ser. No. 699,655 filed on June 24, 1976 by Terasawa et al.

The ion source 20 can be selected from among known means, but should preferably be of the type which permits producing a large amount of ion current such as Duoplasmatron type, Duopigatron type, hollow cathode type or P.I.G. type. The accelerator 22, which can also be selected from among known ones, consists generally of an electrode group of two or more stages. The electrode group serves to accelerate the ions and, at the same time, converges or diverges the ion beam.

Apertures 26 and 28 may be provided, if desired, between the ion source 20 and the accelerator 22 and between the accelerator 22 and the implantation chamber 24, respectively. These apertures, which should naturally permit passage of ions and gaseous molecules, provide a resistance against the gaseous stream so as to create pressure difference between the ion source 20, the accelerator 22 and the implantation chamber 24. In some cases, the apertures 26 and 28 can be formed to provide a part of the ion source 20 or the accelerator 22, for example an ion extracting electrode.

The gaseous radioactive material which is to be stored is temporarily housed in a gas reservoir 10 and supplied to the ion source 20 through a valve 12. The system comprising the implantation chamber 24, the accelerator 22 and the ion source 20 is evacuated through a valve 42 by the evacuation means 40 such as a cryogenic pump. It is convenient to use rollers 32 for moving the solid material 30 at a predetermined speed.

In the apparatus of this invention, a cylinder 50 and a valve 54 are provided for introducing a metal halide or a metal carbonyl to the vicinity of the solid material 30. Of course, such a metal compound is housed in the cylinder 50. Where reduction by hydrogen is employed for depositing the elemental metal on the surface of the solid material 30, a hydrogen gas cylinder 52 and a valve 56 are provided as shown in the drawing. Of course, the cylinder 52 can be used as the reservoir of a carrier gas which is introduced into the implantation chamber 24 together with the metal halide or the metal carbonyl compound. It is seen that a pipe 57 connected to the metal compound cylinder 50 and a pipe 58 connected to the gas cylinder 52 for hydrogen gas or carrier gas are combined downstream of the valves 54 and 56.

The solid material 30 is heated by bombardment with the ionized radioactive material. In order to prevent the thermal damage of the solid material 30, a temperature control means 60, particularly a cooler, is used in general for cooling the solid material 30. A known cooler using a suitable cooling medium can be used as the temperature control means 60.

Where radiolysis is used for decomposing the metal halide or the metal carbonyl it is possible to mount means for emitting ultraviolet rays, X-rays, etc. at the upper portion of the implantation chamber 24.

In operating the apparatus of this invention, the implantation chamber 24 is evacuated first to a vacuum of less than $10^{-3}$ torr by the evacuation means 40. Then, a radioactive gas, for example, Kr-85 is supplied from the gas reservoir 10 to the ion source 20 through the valve 12. Kr-85 is partly ionized by the ion source 20 with the remainder removed through the evacuation means 40. Thus, the gaseous radioactive molecules flow from the ion source 20 into the evacuation means 40 through the accelerator 22 and the implantation chamber 24. Naturally, a pressure difference is created among portions of the apparatus body by the presence of the apertures 26 and 28. Incidentally, it is possible to recycle the radioactive gas removed by the evacuation means 40 to the gas reservoir 10.

The ion of, for example, Kr-85 generated by the ion source 20 is accelerated by the accelerator 22 to a predetermined energy level of, for example, 45 KeV. The surface of the solid material 30 is bombarded by the accelerated ion, resulting in implantation of the radioactive material into the solid material. Incidentally, particles of the radioactive material are not necessarily in the form of ion upon the implantation as far as they are running at a sufficiently high speed.

While implantation is being carried out as described above, a metal compound like, for example, nickel carbonyl is introduced from the cylinder 50 to the vicinity of the implantation surface of the solid material 30 through the valve 54. Nickel carbonyl, which is liquid under atmospheric pressure and room temperature, is gasified upon entrance into the implantation chamber 24 maintained in vacuum. Since the solid material 30 is maintained at, for example, 300° C. by the temperature control means 60, the nickel carbonyl introduced to the vicinity of the implantation surface of the solid material 30 is decomposed by mainly thermal decomposition so as to deposit nickel metal on the implantation surface of the solid material 30. At the same time, the carbon monoxide gas generated by the thermal decomposition of nickel carbonyl is removed by the evacuation means 40.

The metal deposition rate can be controlled by controlling the introduction rate of the metal halide or the metal carbonyl. Suppose nickel carbonyl is introduced at the rate of $5.6\times10^{-5}$ ml NTP/sec, i.e. 0.2 ml NTP/hr, relative to 1 $cm^2$ of the implantation surface area of the solid material. In this case, the nickel deposition rate is as calculated below.

$$\begin{aligned} &5.6 \times 10^{-5} \text{ ml NTP/sec/cm}^2 \\ &= 0.04 \text{ torr. cc/cm}^2 \text{ sec} \\ &= 2.5 \times 10^{-9} \text{ mol/cm}^2 \text{ sec} \\ &= 1.5 \times 10^{15} \text{ Ni/cm}^2 \text{ sec} \\ &= 1.6 \text{ A/sec} = 0.6\ \mu\text{/hr} \end{aligned}$$

In the above calcuration, the density of the deposited nickel layer is set at 8.9 $g/cm^3$. It is seen that the deposited nickel layer grows at the rate of 0.6 $\mu$/hr in thickness if nickel carbonyl is introduced at the rate of 0.2 ml NTP/hr. The nickel deposition rate mentioned is high enough to detain stably the implanted krypton in the deposited layer because the Kr ion accelerated to an energy level of 45 KeV is implanted in general to a depth of about 500 Å.

As described above in detail, this invention permits implanting high speed particles of radioactive material into a solid material simultaneously with forming a new metal layer on the surface of the solid material. Quite naturally, the implanted radioactive material can be stored more satisfactorily if the operation for forming the metal layer is carried for a reasonable period of time after termination of the implantation operation.

In this invention, sputtering is not used for forming a metal layer on the surface of a solid material, resulting in a simple, efficient and economic operation of the apparatus for storing radioactive materials.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for storing radioactive materials in a solid material, comprising:

an ion source for ionizing gaseous radioactive material to be stored;

an accelerator for accelerating the ionized radioactive material, the accelerator consisting of an electrode group;

an implantation chamber for housing the solid material into which the accelerated ions of the radioactive material are to be implanted;

evacuation means connected to the implantation chamber;

means for introducing at least one metal compound selected from metal halides and metal carbonyls to the vicinity of the solid material;

means for controlling the temperature of the solid material to fall within the range suitable for decomposing the metal compound to deposit the elemental metal on the surface of the solid material and for permitting implantation of the radioactive material into the solid material simultaneously with formation of a new metal layer on the surface of the solid material; and means forming apertures provided between the ion source and the accelerator and between the accelerator and the implantation chamber so as to create a pressure difference between the ion source, the accelerator and the implantation chamber.

2. An apparatus as set forth in claim 1, which further comprises means for moving the solid material at a predetermined speed, thereby performing continuous operation.

3. An apparatus as set forth in claim 1, said means for introducing at least one metal compound further comprising means for introducing the at least one metal compound at a partial pressure of $10^{-1}$ to $10^{-4}$ torr.

4. An apparatus as set forth in claim 1, wherein said metal carbonyls comprise nickel carbonyl, iron carbonyl or chromium carbonyl.

5. An apparatus as set forth in claim 1, wherein said metal halides comprise chlorides, bromides and iodides of silicon, germanium, titanium, zirconium, hafnium, vanadium, chromium, tantalum, iron, cobalt, copper, beryllium, niobrium, molybdenum and tungsten.

6. The apparatus according to claim 1, wherein the temperature control means controls the temperature of the solid material to fall within the range of from 300° C. to 800° C.

7. The apparatus according to claim 1, or 6, which further comprises means for introducing a carrier gas for the metal compound.

8. The apparatus according to claim 1 or 6, which further comprises means for introducing hydrogen gas together with the metal halide.

* * * * *